US005300181A

United States Patent [19]

Yamaguchi

[11] Patent Number: 5,300,181

[45] Date of Patent: Apr. 5, 1994

[54] LABEL STICKING APPARATUS

[75] Inventor: Yasuhiro Yamaguchi, Osaka, Japan

[73] Assignee: Osaka Sealing Printing Co., Ltd., Osaka, Japan

[21] Appl. No.: 956,533

[22] Filed: Oct. 5, 1992

[30] Foreign Application Priority Data

| | | | |
|---|---|---|---|
| Oct. 9, 1991 | [JP] | Japan | 3-290621 |
| Dec. 2, 1991 | [JP] | Japan | 3-347854 |
| Dec. 2, 1991 | [JP] | Japan | 3-347855 |
| Sep. 9, 1992 | [JP] | Japan | 4-268036 |

[51] Int. Cl.[5] ..... B44C 1/00

[52] U.S. Cl. ..... 156/542; 156/DIG. 42; 156/DIG. 37; 156/DIG. 24

[58] Field of Search ..... 156/541, 542, 361, 362, 156/363, 540, 572, DIG. 31, DIG. 38, DIG. 39, DIG. 40, DIG. 41, DIG. 42

[56] References Cited

U.S. PATENT DOCUMENTS

| | | | |
|---|---|---|---|
| 2,286,458 | 3/1941 | Bowman | 156/542 |
| 2,763,482 | 9/1956 | Messuer | 156/DIG. 31 |
| 3,008,866 | 11/1961 | Kingsley | 156/540 |
| 3,561,749 | 2/1967 | Grover | 269/227 |
| 3,729,362 | 4/1973 | French | 156/230 |
| 4,025,382 | 5/1977 | Del Rosso | 156/542 |
| 4,032,388 | 6/1977 | Dunning | 156/DIG. 31 |
| 4,124,436 | 11/1978 | Pettis | 156/542 |
| 4,210,484 | 7/1980 | Cuamkshaw | 156/542 |
| 4,255,220 | 2/1979 | Kucheck | 156/DIG. 38 |
| 4,479,770 | 10/1954 | Slat | 425/503 |
| 4,878,982 | 11/1989 | Ogata | 156/361 |

*Primary Examiner*—David A. Simmons
*Assistant Examiner*—Mark De Simone
*Attorney, Agent, or Firm*—Jordan and Hamburg

[57] ABSTRACT

A label sticking apparatus comprises, for example, three pushing devices. The pushing devices serve to press the label held by the sucking plate against an object to be labeled. The pressing device includes pressing rods. The pressing rods are held by a holding member with each one coil spring. A label pressing member is attached to the lower end of the pressing rod. The label pressing member has a hollow and tubular body made of a soft material. The holding member is attached to the forward end of a rod of an actuator comprising a cylinder etc. Under the holding member, a stopper for suddenly stopping the holding member is disposed.

8 Claims, 9 Drawing Sheets

LABEL STICKING APPARATUS

BACKGROUND OF THE INVENTION

1. Field of the Invention

The present invention relates to a label sticking apparatus and particularly to a label sticking apparatus for sticking a label to the surface of an object to be labeled.

2. Description of the Prior Art

As a label sticking apparatus of prior art, there has been generally known that of a type in which a label peeled by a peeler is pressed against the surface of an object to be labeled by means of a sticking roller and that of a type in which a label peeled by a peeler is sucked by a sucker and then stuck to the surface of an object to be labeled by means of a pressing device.

With a label sticking apparatus of such type, however, the vertical stroke of the sticking roller or the pressing device for pressing the label against the surface of the object to be labeled is predetermined, and the sticking roller or the pressing device is lowered to a predetermined position apart from the distance to the object to be labeled. Hence, if the size of the object to be labeled is varied, the sticking roller or the pressing device possibly either fail to reach the object to be labeled or crush the object to be labeled, this resulting in failure to press the label exactly in place on the surface of the object to be labeled and failure to stick the label in place and neatly.

In order to eliminate such defects, therefore, there has been proposed a label sticking apparatus such as disclosed in Japanese Patent Provisional Publication No. 209518/1984.

Since, even with a label sticking apparatus disclosed in Japanese Patent Provisional Publication No. 209518/1984, the sticking apparatus comprises a label pressing portion made of soft material such as a rubber or the like having a flat surface and a supporting member made of a stiff material such as a metal, the former having a single and relatively broad surface e.g. somewhat larger than the label, it is difficult to stick the label closely to the surface of the object to be labeled if the surface of object is uneven or stepped.

SUMMARY OF THE INVENTION

The primary object of the present invention is to provide a label sticking apparatus capable of sticking a label precisely and neatly to an uneven, stepped or slanted surface of the object to be labeled.

The label sticking apparatus of the present invention comprises a plurality of pressing means for pressing the label onto an object to be labeled, a holding means for holding the plurality of pressing means with a first elastic body individually and free to advance or retreat, a pushing-out means for pushing out the holding means along the advancing direction, a stopping means for suddenly stopping the holding means which has been pushed out along the advancing direction by the pushing-out means, and wherein the plurality of pressing means are stopped by the stopping means and thereafter move by inertia along the advancing direction of the pressing means against the elasticity of the first elastic body.

The holding means is pushed by the pushing means in its advancing direction. Then, of the plurality of pressing means moves in the advancing direction of the pushing means.

The holding means is then suddenly stopped by the stopping means. Thereafter, the plurality of pushing means move by inertia along the advancing direction of the pressing means against the elasticity of the first elastic body.

As a result, the label is pressed against and stuck to the surface of the object to be labeled by the plurality of pressing means. In this case, since the plurality of pressing means are held individually by the holding means free to advance or retreat, the label can be stuck to the surface of the object to be labeled precisely and neatly even if it is uneven, stepped or slanted.

According to the present invention, it is possible to obtain a label sticking apparatus that the label can be stuck to the surface of the object to be labeled precisely and neatly even if it is uneven, stepped or slanted.

Another label sticking apparatus according to the present invention is one provided with a pressing means for pressing a label onto the surface of the object to be labeled, wherein the pressing means comprises an air pipe for sending air therethrough, a pneumatic passive element disposed in the vicinity of an air outlet to respond to the airflow, and a label pressing member attached to the pneumatic passive element, and the body of the label pressing member has a hollow and tubular body made of a soft material to press the label with one end thereof.

The pneumatic passive element is moved by the air blown out of the air pipe. In result, the label is pressed and stuck to the surface of the object to be labeled by means of the label pressing member. Since the body of label pressing member is in hollow and tubular shape and made of a soft material, and one end thereof is made to press the label, the label pressing member deforms to accommodate the unevenness or stepping in the surface of the object to be labeled.

According to the present invention, since the label pressing member is made to deform to accommodate the unevenness or stepping in the surface of the object to be labeled, the label can be stuck precisely and neatly even if it has unevenness or stepping therein.

Still another label sticking apparatus according to the present invention is one provided with a pressing means for pressing the label onto the object to be labeled, wherein the pressing means comprises an actuator having a rod and a label pressing member attached to the rod of the actuator, and the label pressing member has a hollow and tubular body made of a soft material to press the label with one end thereof.

The label pressing member is moved by the rod of the actuator. In result, the label is pressed and stuck to the surface of the object to be labeled by means of the label pressing member. In this case, since the body of the label pressing member is in hollow and tubular shape and made of a soft material, and one end of the body is made to press the label, the label pressing member deforms to accommodate the unevenness or stepping in the surface of the object to be labeled.

According to the present invention, since the label pressing member deforms to accommodate the unevenness and stepping in the surface of the object to be labeled, the label can be stuck precisely and neatly to the surface of the object to be labeled even if it has unevenness or stepping therein.

The aforementioned objects, features, phases and advantages of the present invention will become more apparent from the following detailed description of the embodiments with reference of the accompanied drawings.

DESCRIPTION OF THE PREFERRED EMBODIMENTS

Figure 1:
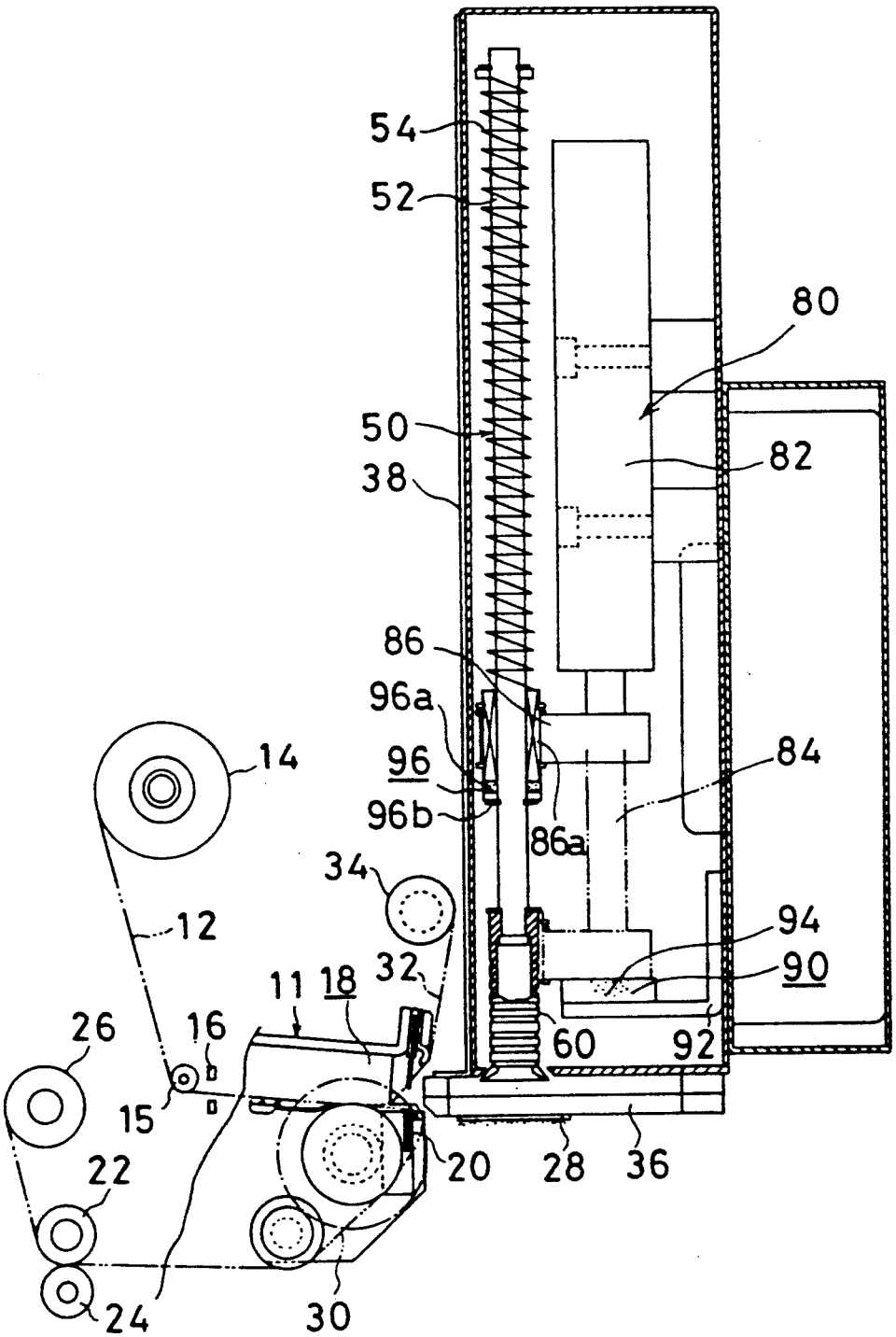
FIG. 1 is an approximate side view showing an embodiment of the present invention.
Figure 2:
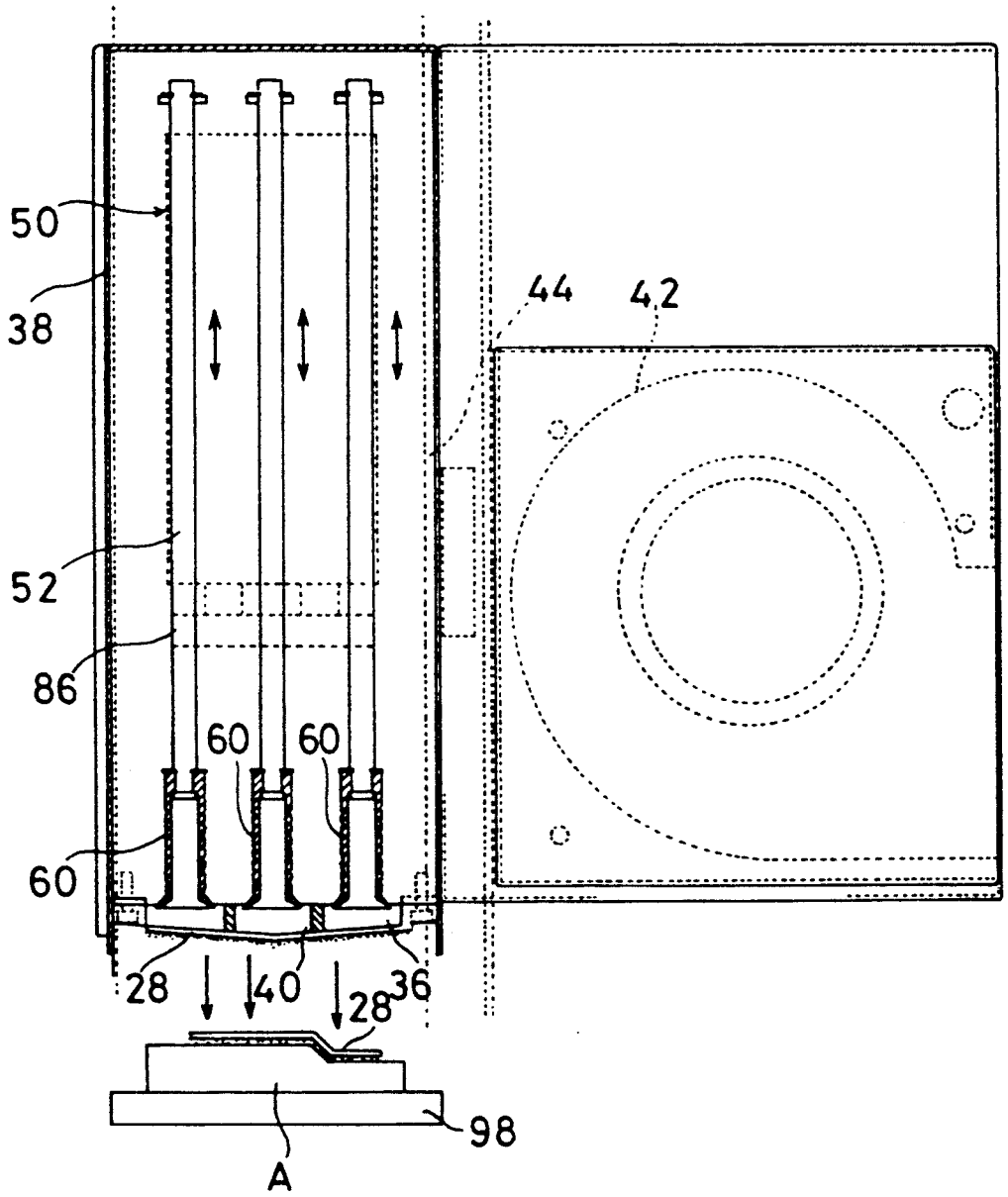
FIG. 2 is an approximate front view showing the embodiment in FIG. 1.

FIG. 1 is an approximate side view showing the present invention and FIG. 2 is an approximate front view showing the embodiment in FIG. 1.

The label sticking apparatus 10 includes a label issuing device 11 for printing and issuing labels. The label issuing device 11 comprises a holding reel 14 for holding a belt-like continuum of labels 12 in roll form, a guide roller 15, a label detector 16, a heat-sensitive transfer device 18, a peeler 20, a feeder roller 22, a nip roller 24 and a winding reel 26.

The continuum of labels 12 includes a belt-like release paper 30. The release paper 30 includes a belt-like release baseboard such as paper, and on the surface of the baseboard there is formed a layer of release agent by coating with silicone or the like. On the surf ace of the release paper 30, plural labels 28 of ordinary paper with an adhesive layer formed on the back thereof are temporarily adhered at a distance from each other.

The holding reel 14 is for holding in roll form a belt-like continuum of labels 12.

The guide roller 15 is for guiding the continuum of labels 12.

The label detector 16 comprises a photoelectric sensor and the like to which the continuum of labels 12 is guided.

The label detector 16 is for detecting the pitch of the labels 28 or presence of the labels 28 in the continuum of labels 12.

The heat-sensitive transfer device 18 comprises a ribbon feeding reel (not shown) for holding a belt-like heat-sensitive transfer ribbon 32 in roll form, a thermal head and a ribbon winding reel 34. The heat-sensitive transfer ribbon 32 is arranged to come into contact with the surface of the label 28 of the continuum of labels 12 by means of the ribbon feeding reel and the ribbon winding reel 34. Meanwhile, the thermal head is so arranged that its head portion comes into contact with the portion where the heat-sensitive ribbon 32 overlaps the labels 28 of the continuum of labels 12.

The peeler 20 is made of a stiff material such as a metal and has its forward end portion with acute angle. The forward end portion serves to turn back the release paper 30 of the continuum of labels 12 suddenly so as to peel the label 28 off the release paper 30.

The feeder roller 22 is coupled with a motor. The nip roller 24 pushes toward the feeder roller 22. These feeder roller 22 and nip roller 24 are for carrying the release paper 30 of the continuum of labels 12 therebetween.

The winding reel 26 is for winding the release paper 30 of the continuum of labels 12 in roll form.

Further, in the vicinity of the peeler 20, a suction plate 36 is provided. The suction plate 36 is fixed to the underside of a suction box 28 made from a material which is substantially impermeable. A plurality of suction holes 40 are formed to the suction plate 36. A blower 42 is connected to the suction box 38. The blower 42 is for lowering the inside pressure of the suction box 38. That is, the blower 42 exhausts the air in the suction box 38 through exhaust holes 44. Thus, the blower 42 and the like can be used to produce a suction force in the suction holes 40 of the suction plate 36 for sucking the label 28.

Inside the suction box 38, there are provided three pressing devices 50 as pressing means. These pressing devices 50 are for pressing the label 28 toward the object to be labeled A. The pressing device 50 comprises a cylindrical pressing rod 52 made of a metal, which is disposed vertically in the suction box 38.

The upper portion of the pressing rod 52 is set through a coil spring 54 as a first elastic body. The upper end of the spring 54 is fixedly secured to the upper end of the pressing rod 52.

A label pressing member 60 which is made of a soft material such as non-rigid plastic is provided at the lower end of the pressing rod 52.

Figure 3:
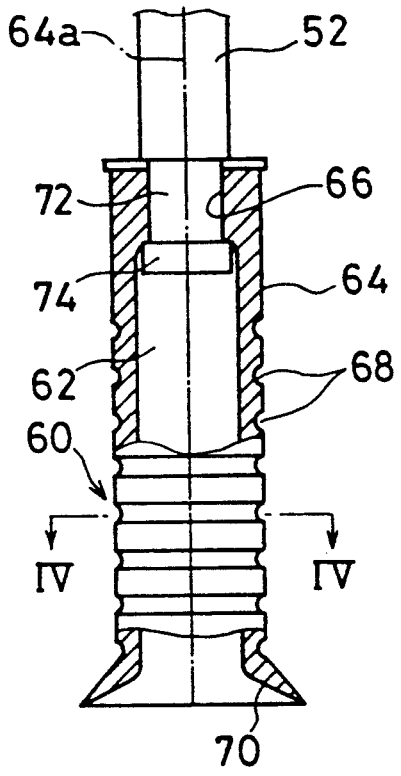
FIG. 3 is an elevational view in section showing a label pressing member used in the embodiment in FIG. 1.
Figure 4:
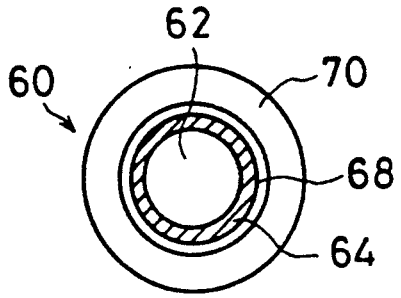
FIG. 4 is a sectional view taken along the line IV-IV in FIG. 3.

As shown in FIGS. 3 and 4, the label pressing member 60 includes a cylindrical body 64 with a cavity 62. A connecting hole 66 is formed at the upper portion of the cylindrical body 64. The connecting hole 66 is for connecting the cylindrical body 64 with the pressing rod 52 lest the axis **64*a* of the cylindrical body 64 should be in parallel with the surface of the label 28 (In this embodiment it is substantially perpendicular to the surface of the label 28**).

Grooves 68 for buffering are formed around the outer periphery of the cylindrical body 64.

A pressing part 70 is formed at the lower end of the cylindrical body 64. The pressing part 70 is formed in generally flange-shape so as to be flared and thinner toward its outer periphery end.

The lower end portion of the pressing rod 52 is inserted into the connecting hole 66 of the label pressing member 60. In this embodiment, the label pressing member 60 is connected with the pressing rod 52 with a relative firmness by the elasticity of the cylindrical body 64.

Also, in this embodiment, the pressing rod 52 has a connecting groove 72 formed in its lowermost portion and a connecting head 74 is formed at the lower end thereof. Hence, the head 74 is fitted in the cavity 62 of the label pressing member 60, and thus the label pressing member 60 is firmly connected with the pressing rod 52.

Further, perpendicularly along the pressing rod 52, a pushing-out device 80 as pushing-out means is provided. The pushing-out device 80 serves to push out the pressing rod 52 of the pressing device 50 toward the object to be labeled A.

The pushing-out device 80 includes an actuator 82 comprising a hydraulic or a pneumatic cylinder, and the actuator 82 is disposed perpendicularly.

A holding member 86 as holding means is fixedly connected to the forward end of a rod 84 of the actuator 82. The holding member 86 includes three bearing units 86*a* comprising, for example, bearings. These bearing units 86*a* hold the three pressing rods 52 slidable vertically.

The lower ends of three springs 54 are fixedly secured to the upper end of the holding member 86.

Under the pushing-out device 80, a stopper 90 as stopping means is formed near the lower end of the stroke of the rod 84 of the actuator 82. The stopper 90 is for suddenly stopping the moving rod 84 of the actuator 82. The stopper 90 includes, for example, an L shaped fixing member 92. A stopper 94 made of a cushioning material such as sponge is stuck to the topside of the fixing member 92 by means of an adhesive double coated tape. The fixing member 92 is fixed at a proper position of the suction box 38 so that the holding member 86 pushed out by the rod 84 of the pushing-out device 80 comes into contact with the stopper 94.

A stopping member 96 is provided in the mid portion of the pressing rod 52 below the holding member 86. The stopping member 96 includes a ring-shaped stopping material 96*a* made of such as sponge. The pressing rod 52 is set through the stopping material 96*a* below the holding member 86. The stopping member 96*a* is held from under by, for example, a ring 96*b*. The ring 96*b* is fixed in the mid portion of the pressing rod 52 below the holding member 86. The ring 96*b* serves to limit the upward movement of the pressing rod 52 against the holding member 86. The impact force caused to occur between the pressing rod 52 and the holding member 86 is absorbed by the stopping material 96*a*.

Further, a conveyor 98 for conveying the object to be labeled A is provided under the sticking plate 36.

Now, the mode of manipulation or operation of the label sticking apparatus 10 is described.

First the continuum of labels 12 is held in roll form on the holding reel 14. One end of the continuum of labels 12 is set through the label detector 16 via the guide roller 15 and further led to the transfer position of the heat-sensitive transfer device 18. Then, the release paper 30 of the continuum of labels 12 is suddenly turned back by the peeler 20 and is led through between the feeder roller 22 and the nip roller 24 to be fixed to the winding reel 26. And, the continuum of labels 12 is carried by rotating the feeder roller 22 and the winding reel 26.

The labels 28 on the continuum of labels 12 carried from the holding reel are detected by the label detector 16 and then further carried to the heat-sensitive transfer device 18.

On the surface of the label 28, letters, figures, symbols or the like are formed by transferring a part of the heat-sensitive transfer ribbon 32 at the heat-sensitive transfer device 18. At the time of heat-sensitive transfer, the heat-sensitive transfer ribbon 32 is carried in the same direction as the label 28 at the same speed as the label 28.

Then, the labels 28 of the continuum of labels 28 are peeled off from the release paper 30 by the peeler 20. The release paper 30 is then wound by the winding reel 26 through between the feeder roller 22 and the nip roller 24.

The peeled labels 28 are sent under the suction plate 36 one after another. And the label 28 thus sent out is sucked to the underside of the sucking plate 36 by the sucking force produced in the sucking holes 40 by the blower 42 or the like.

Next, the rod 84 of the actuator 82 of the pushing-out device 80 comes down fast. Thereby, the holding member 86 comes down, and the stopping member 96 is pushed downward under the holding member 86 and the pushing rod 52 is suddenly lowered.

Then, the lowering holding member 86 comes into contact with the stopper 90, and the rod 84 of the actuator 82 comes to a sudden stop. The pressing rod 52 with its force of inertia comes down further against the elasticity of the spring 54. And the label pressing member 60 presses down the label 28 sucked to be held on the underside of the sucking plate 36. And the label 28 is stuck to the surface of the object to be labeled A which has been conveyed by a conveyor 98.

Since it is so arranged that the three sets of pressing rods 52 etc. come down individually and independently, the label 28 can be stuck to the surface of the object to be labeled A precisely and neatly even if the surface of the object to be labeled A has unevenness, stepping or slant in its surface.

Moreover, since the label pressing member 60 of the label sticking apparatus 10 is made to deform to accommodate the unevenness, stepping or slant in the surface of the object to be labeled A, the label 28 can be stuck to the surface of the object to be labeled A precisely and neatly.

Also, the label pressing member 60 absorbs the impact from the lowering pressing rod 52, and hence there is no risk of the object to be labeled A being crushed thereby.

Figure 5:
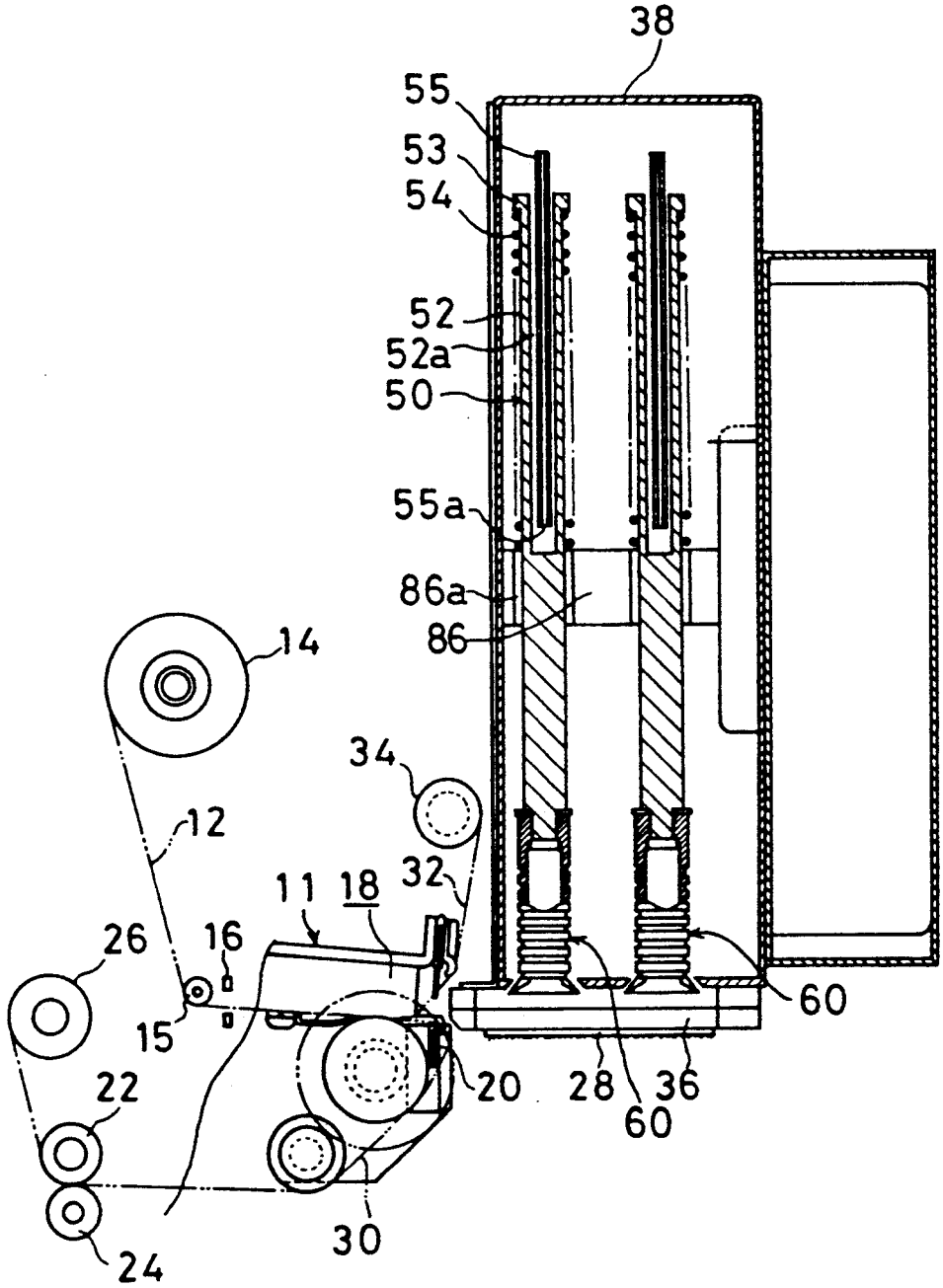
FIG. 5 is an approximate side view showing an another embodiment of the invention.
Figure 6:
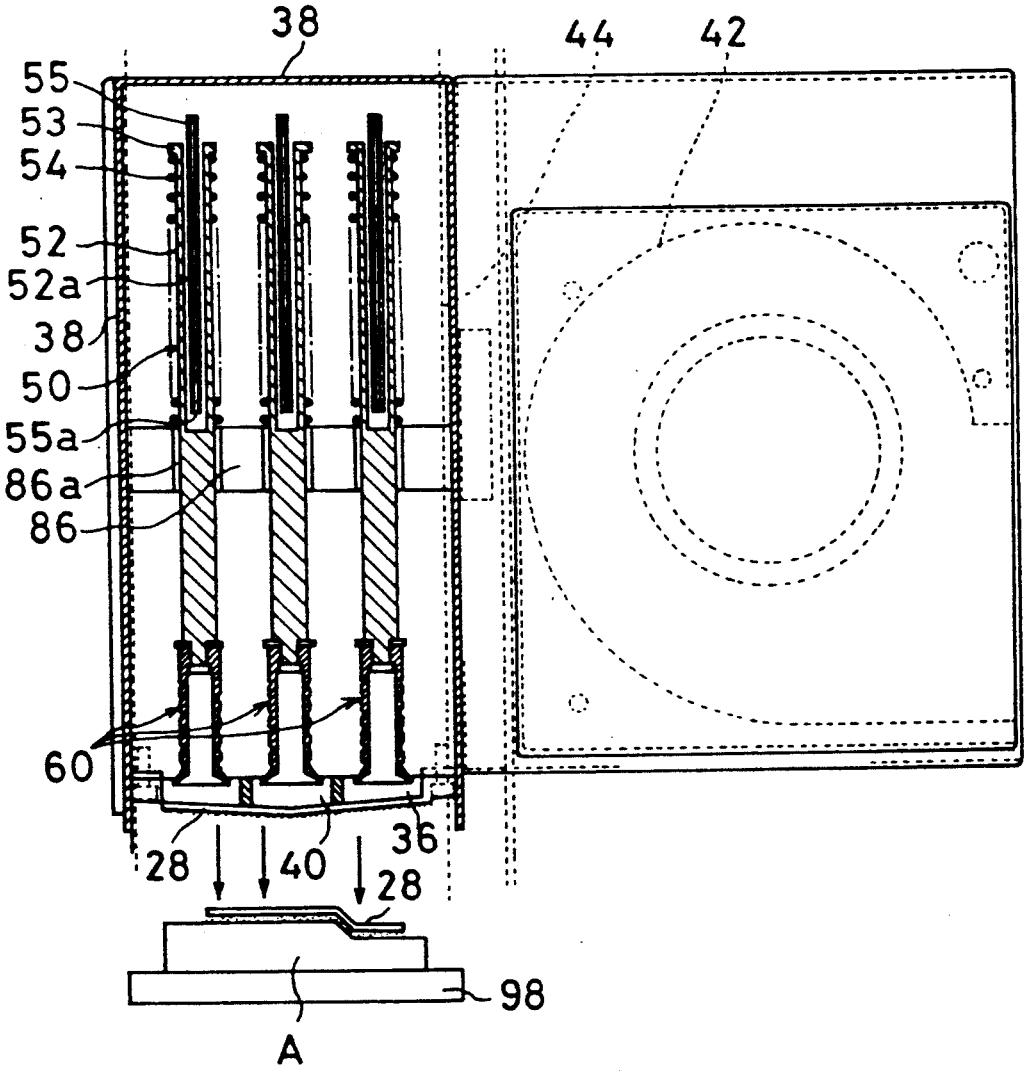
FIG. 6 is an approximate front view showing the embodiment in FIG. 5.

FIG. 5 is an approximate side view showing an another embodiment of the invention and FIG. 6 is an approximate front view corresponding to FIG. 5.

The embodiment shown in FIGS. 5 and 6 is different from the embodiment shown in FIGS. 1 through 4 especially in that the holding member 86 is fixed amid the height of the sucking box 38. Also, six bearing units 86*a* are arranged to the holding member 86. Six pressing rods 52 as pneumatic passive elements are held to the bearing units 86*a* so as to be vertically slidable. The label pressing member 60 is connected to the lower end of each pressing rod 52.

A flange 53 is formed at the upper end of each pressing rod 52, and the upper end of the spring 54 is secured to the flange 53.

In the pressing rod 52, a cavity 52*a* is formed extending from the upper end to a mid point. And, an air pipe 55 is inserted into the cavity 52*a*. In this case, one end portion of the air pipe 55 including an air outlet 55*a* is inserted into the cavity 52*a*.

Further, the air pipe 55 is connected with a compressor (not down), hence air can be blown out of the outlet 55*a* of the air pipe 55.

The embodiment shown in FIGS. 5 and 6 is different from the embodiment shown in FIGS. 1 through 4 especially in that the pressing rod 52 is brought down fast by the air blown out of the air pipe 55 through the outlet 55*a*.

As the pressing rod 52 comes down, the label 28 is pressed onto the surface of the object to be labeled A by the label pressing member 60 to be stuck thereto in the same way as the embodiment of FIGS. 1 through 4.

The label 28 can be stuck to the surface of the object to be labeled A precisely and neatly even if there is unevenness, stepping or slant, because the six sets of pressing rods 52 etc. are arranged to come down individually and independently.

Further, in this label sticking apparatus 10 too, since the label pressing member 60 is made to deform to accommodate the unevenness, stepping or slant in the surface of the object to be labeled A, hence the label 28 can be stuck on the surface of the object to be labeled A precisely and neatly even if the surface of the object has such irregularities therein.

Also, the label pressing member 60 absorbs the impact from the lowering pressing rod 52 and hence there is no risk of the object to be labeled A being crushed thereby.

Figure 7:
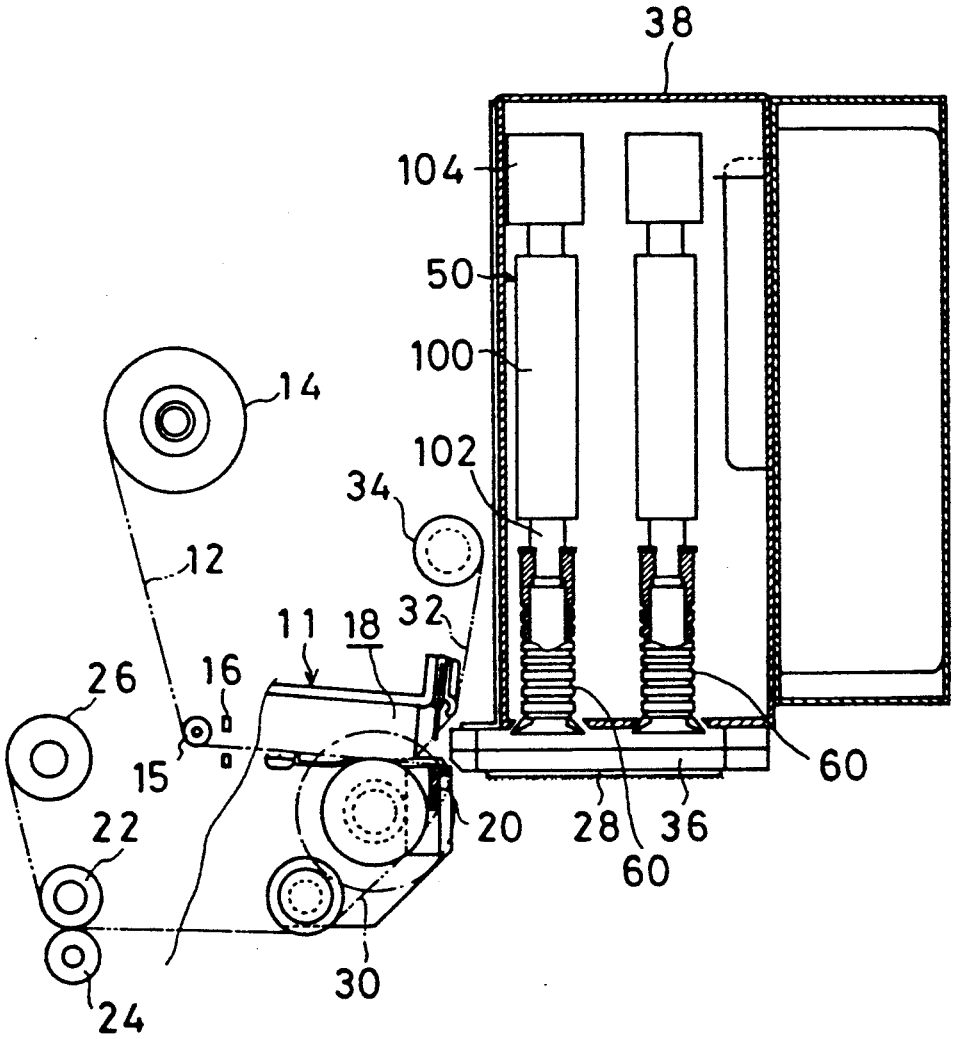
FIG. 7 is an approximate side view showing still another embodiment of the invention.
Figure 8:
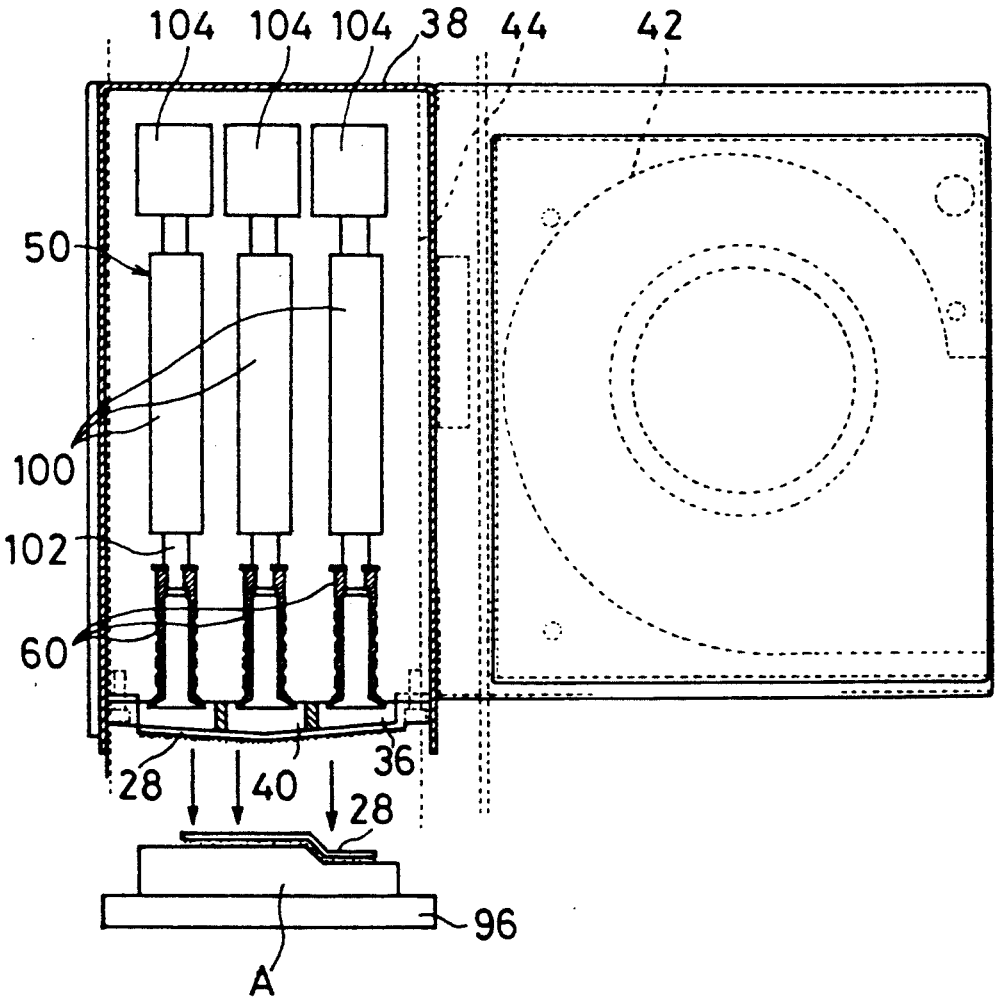
FIG. 8 is an approximate front view showing the embodiment in FIG. 7.

FIG. 7 is an approximate side view showing still another embodiment of the invention and FIG. 8 is an approximate front view of the embodiment shown in FIG. 7.

The embodiment shown in FIGS. 7 and 8 is different from the embodiment shown in FIGS. 1 through 4 especially in that it includes the six pressing devices 50. The pressing device 50 includes an actuator 100 comprising a control cylinder such as an air cylinder and the actuator 100 has a rod 102.

At the forward end of the rod 102 of each actuator 100, a label pressing member 60 is connected. Like the lower end of the pressing rod 52 of the embodiment shown in FIGS. 1 through 4, the forward end portion of the rod 102 has a connecting groove formed therein and a connecting head is formed under the groove. Hence the label pressing member 60 can be secured firmly to the forward end of the rod 102.

Each actuator 100 is connected to an air compressor or a hydraulic pump via a controller 104 such as a solenoid valve, hence the rod 102 of the actuator 100 can be moved vertically by means of the controller 104.

The embodiment shown in FIGS. 7 and 8 is different from the embodiment shown in FIGS. 1 through 4 especially in that the label pressing member 60 is lowered fast when the rod 102 of the actuator 100 is moved downward.

When the rod 102 is lowered, the label 28 is pressed against and stuck to the surface of the object to be labeled A by the label pressing member 60 in the same manner as in the embodiment shown in FIGS. 1 through 4.

The label 28 can then be stuck to the surface of the object to be labeled A precisely and neatly even if there is unevenness, stepping or slant, because the six sets of rods 102 etc. are arranged to come down individually and independently.

Further, in this label sticking apparatus 10 too, since the label pressing member 60 is made to deform to accommodate the unevenness, stepping or slant in the surface of the object to be labeled A, hence the label 28 can be stuck on the surface of the object to be labeled A precisely and neatly even if the surface of the object has such irregularities therein.

Also, the label pressing member 60 absorbs the impact from the lowering pressing rod 52 and hence there is no risk of the object to be labeled A being crushed thereby.

Although, in the aforementioned embodiment, the expression on the surface of the label is made by the use of a part of the heat-sensitive transfer ribbon, but the expression on the surface of the label may as well be printed by the use of ordinary inks, or it is also possible to form the heat-sensitive developing layer on the entire surface of the label and develop the expression by heating a part of the heat-sensitive developing layers.

Although, in the above embodiments, three or six sets of pressing devices are provided, it does not mean that the number of the sets of pressing devices is limited to three or six.

Figure 9:
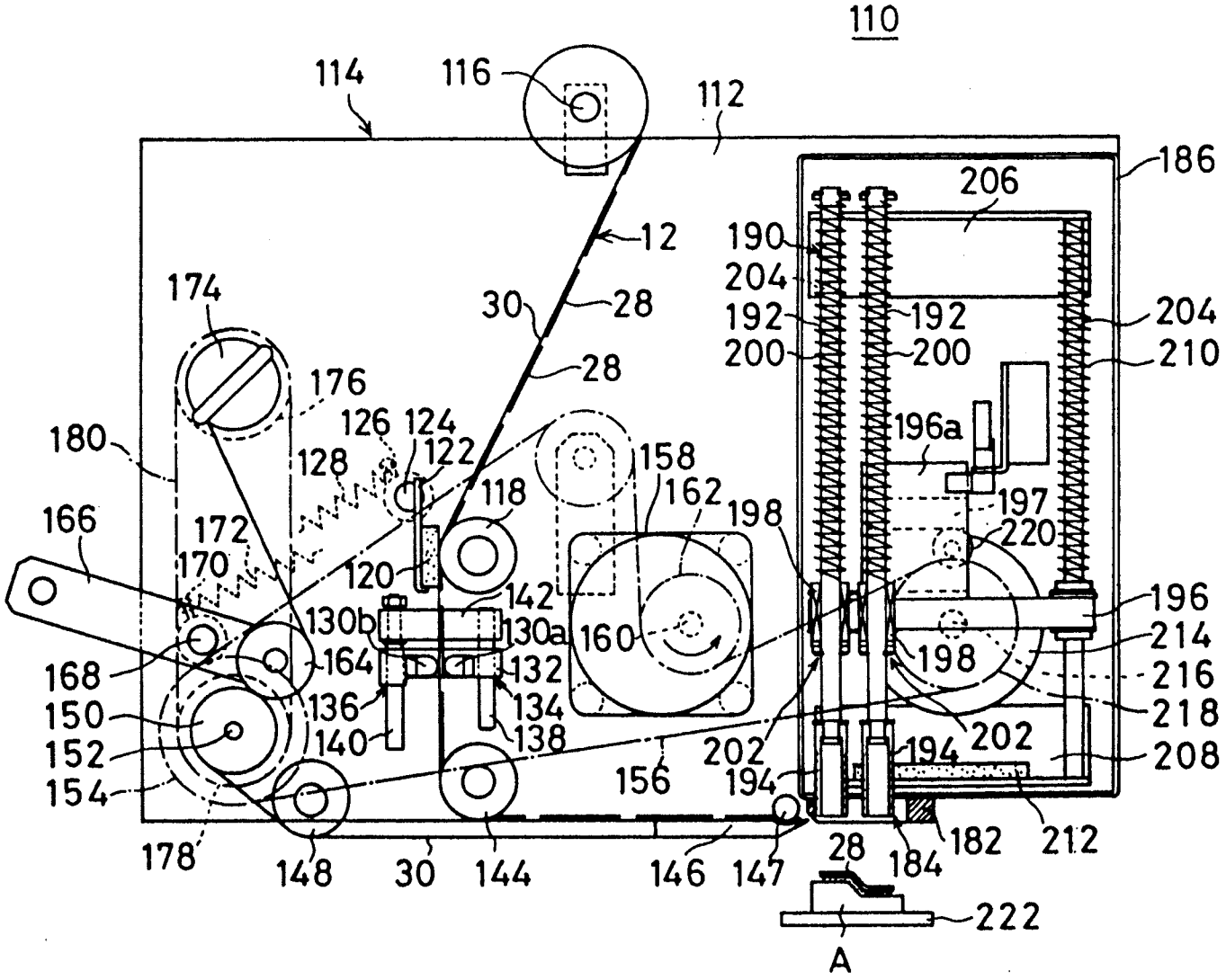
FIG. 9 is an approximate side view showing still further embodiment of the invention.
Figure 10:
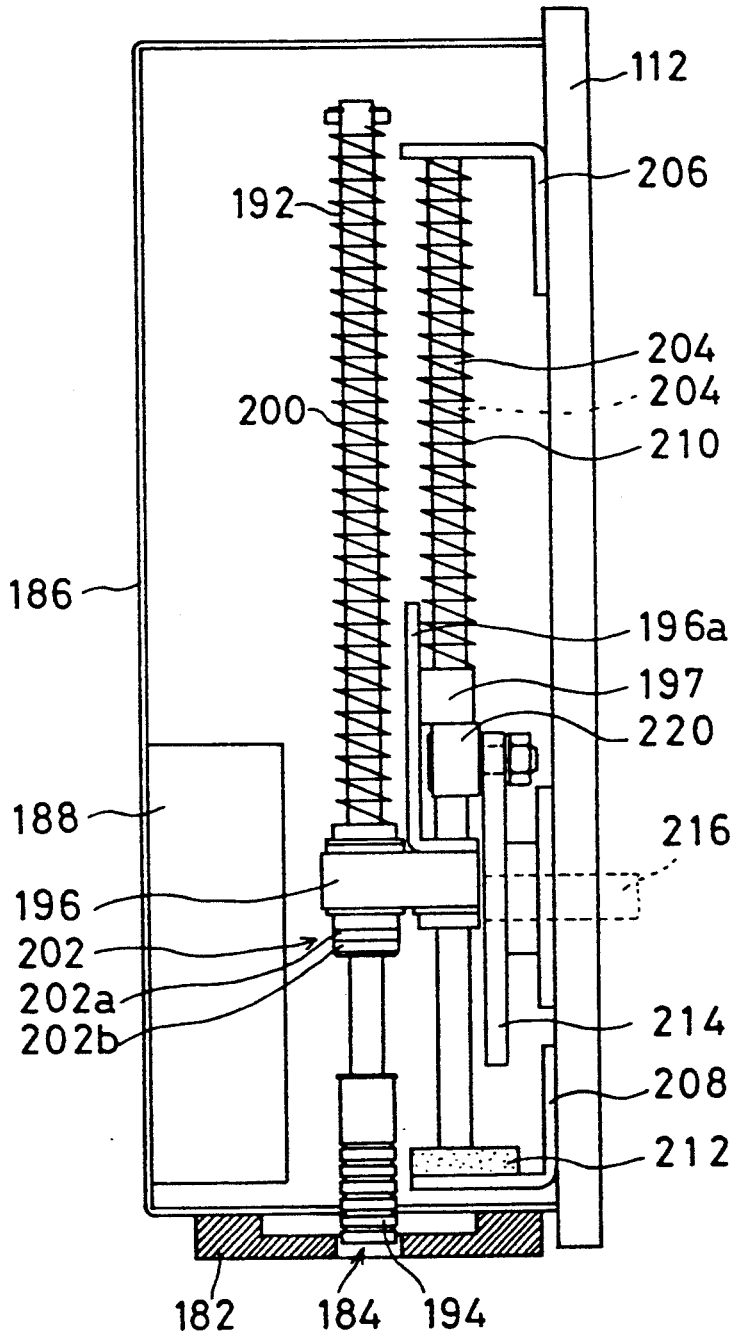
FIG. 10 is an approximate front view showing the embodiment in FIG. 9.

FIG. 9 is an approximate side view of still another embodiment of the invention and FIG. 10 is an approximate front view of the embodiment shown in FIG. 9.

The label sticking apparatus 110 includes a base 112, which is provided with a label issuing device 114 for issuing labels.

The label issuing device 114 includes a holding reel 116. The holding reel 116 is mounted above the base 112. The holding reel 116 is for holding the continuum of labels 12 in roll form. The continuum of labels 12 includes a belt-like release paper 30. The release paper 30 includes a belt-like baseboard of such as paper, and a release layer of silicone or the like is formed on the surface of the release baseboard. And, a plurality of labels 28 of ordinary paper with a layer of adhesive formed on the back thereof are temporarily stuck at a distance with each other on the release paper 30. On the surface of this label 28, expression of letters, figures, symbols or the like is already made in this embodiment.

Under the holding reel 116, a guide roller 118 is disposed. The guide roller 116 is for guiding the continuum of labels 12.

Further, in the vicinity of the guide roller 118, a pressing member 120 made of felt or the like is provided. The pressing member 120 cooperates with the guide roller 118 to nip the continuum of labels 12 therebetween lest it should slacken. The pressing member 120 is bonded to one surface of a supporting plate 122. A shaft 124 is fixedly secured to one end of the supporting plate 122. The shaft 124 is rotatably mounted on the base 112. A pin 126 is fixedly secured to the shaft 124. One end of a coil spring 128 is fixedly secured to the pin 126, and the other end of spring 128 is fixedly secured to the base 112. Hence, the pressing member 120 is pushed by the spring etc. toward the guide roller 118.

Under the guide roller 118 and the pressing member 120, a label detector comprising a light emitting element **130*a* and a light receiving element 130*b* or the like is disposed. The label detector is for detecting the pitch of the labels 28 spaced on the continuum of labels 12 and presence thereof. It is so arranged that the continuum of labels 12 is run between the light emitting element 130*a* and the light receiving element 130*b***.

The light emitting element **130*a* and the light receiving element 130*b* of the label detector are fixedly secured to a slider 132. Near one end of the slider 132 a vertical round hole 134 is formed, and near the other end of the slider 132 a vertical female tapped hole 136 is formed. A cylindrical rod 138 is set through the round hole 134 in the slider 132, and a male threaded bolt 140 is screwed through the female tapped hole 136 in the slider 132. The upper end of the rod 138 is secured to the baseplate 142 which is fixedly secured to the base 112, and the upper end of the male threaded bolt 140 is rotatably secured to the baseplate 142. Hence, by rotating the male threaded bolt 140, the light emitting element 130*a* and the light receiving element 130*b* can be displaced vertically together with the slider 132 for proper adjustment of the position of the light emitting element 130a and the light receiving element 130b**.

Under the light emitting element 130a and the light receiving element 130b, a guide roller 144 is disposed. The guide roller 144 serves to guide the continuum of labels 12.

At substantially the same height as the guide roller 144, a peeler 146 is provided at the center of the base 112. The peeler 146 is for turning back the release paper 30 of the continuum of labels 12 to peel off the labels 28 from the release paper 30 and has its forward end portion with acute angle. Above the peeler 146, a column-shaped pressing rod 147 is disposed. The pressing rod 147 is for preventing lifting of the labels 28 peeled off by the peeler 146.

At substantially the same height as the guide roller 144, a guide roller 148 is provided near one end of the base 112. The guide roller 148 is for guiding the release paper 30 of the continuum of labels 12.

Above the guide roller 148, a feeder roller 150 made of rubber or the like is provided. A gear 154 is fixedly mounted on a shaft 152 of the feeder roller 150. The gear 154 is connected with a gear 162 fixedly mounted on a shaft 160 of a motor 158 via a chain 156. Hence it is possible to drive the feeder roller 150 by such as the motor 158.

Further, in the vicinity of the feeder roller 150, a nip roller 164 is disposed. The nip roller 164 is located rotatably at one end of a supporting plate 166. Amid the supporting plate 166, a shaft 168 is fixed securely. The shaft 168 is secured rotatably to the base 112. And, a pin 170 is fixed to the shaft 168. One end of a coil spring 172 is fixed to the pin 170, and the other end of the spring 172 is secured to the base plate 112. Hence, the nip roller 164 is pushed against the feeder roller 150 by the spring 172 etc.

The aforementioned feeder roller 150, nip roller 164 etc. are for nipping and pulling the release paper 30 of the continuum of labels 12.

Above the nip roller 164, a winding reel 174 is disposed. A pulley 176 is mounted on the winding reel 174. Another pulley 178 is mounted on the shaft 152 of the feeder roller 150. The pulleys 176 and 178 are belted together with a belt 180. Hence, the winding reel 174 rotates with the feeder roller 150. The winding reel 174 is for winding the release paper 30 of the continuum of labels 12.

On the base plate 112, a suction plate 182 is disposed in the vicinity of the peeler 146. An oval-shaped suction hole 184 is formed to the suction plate 182. The suction plate 182 is for sucking the label 28 peeled by the peeler 146.

A suction box 186 is disposed above the suction plate 182. As shown in FIG. 10, a blower 188 is disposed in the suction box 186. The blower 188 is for lowering the pressure in the suction box 186 to produce a suction force in the suction hole 184 of the suction plate 182.

Further, in the suction box 186, a pressing device 190 as pressing means is provided. The pressing device 190 is for pressing the label 28 which is sucked to the sucking plate 182 toward the object to be labeled A.

The pressing device 190 comprises two pressing rods 192 made of metal. The pressing rods 192 have thereunder label pressing members 194 respectively. The label pressing member 194 is made of a soft material such as a non-rigid plastic and is formed in hollow and tubular shape.

These pressing rods 192 are held by the holding member 196 as holding means so as to be slidable vertically. Two bearing units 198 are formed in the holding member 196, and two pressing rods 192 are set through the bearing units 198. Above the holding member 196, as shown in FIG. 10, a block-shaped contact member 197 is held in place by an L-sectioned supporting plate 196a.

The upper portions of the pressing rods 192 are set through coil springs 200 as first elastic bodies. The upper ends of these springs 200 are secured to the upper ends of the pressing rods 192, and the lower ends of the springs 200 are secured to near the topside of the holding member 196.

Under the holding member 196, stopping members 202 are provided amid the pressing rods 192. As shown in FIG. 10, the stopping member 202 includes a ring-shaped stopping material 202a of sponge or the like, and the mid portion of the pressing rod 192 is inserted through the stopping material 202a. A ring 202b is secured in the mid portion of the pressing rod 192 under the stopping member 202a.

The holding member 196 is supported vertically slidable by two guiding rods 204. Both ends of the guiding rods 204 are secured to fixing plates 206 and 208.

Above the holding member 196, the guide rods 204 are set through coil springs 210 as second elastic bodies respectively. These springs 210 are for pushing the holding member 196 downward.

Under the holding member 196, a stopper 212 as stopping means is fixed to the fixing plate 208. The stopper 212 is for suddenly stopping the holding member 196 pushed down by the elasticity of the springs 210.

In the vicinity of the holding member 196, a disc 214 constituting a part of a displacing means is provided so as to be rotatable. A shaft 216 is set stationarily at the center of the disk 214. The shaft 216 is mounted rotationarily through the base 112. A gear 218 is stationarily mounted on the shaft 216. The shaft 216 is meshed with the aforementioned chain 156. Hence the disc 214 is rotatable by the motor 158 or the like.

A roller 220 is disposed in contact with outer periphery of the disk 214 so as to be rotatable. When the disc 214 is rotating, the roller 220 is in contact with the underside of the aforementioned contact member 197 and displaces the holding member 196 upward by a given distance against the elasticity of the springs 210, and then moves to be out of contact therewith. FIGS. 9 and 10 show the holding member 196 etc. displaced to the uppermost position by the roller 220.

Under the suction plate 182, a conveyor 222 is provided. The conveyor 222 is for conveyance of the objects to be labeled A which is to be stuck the label 28.

Then the mode of operation of the label sticking apparatus will be described.

First, as shown in FIG. 9, the continuum of labels is held in roll form on the holding reel 116.

One end of the continuum of labels 12 is led through between the guide roller 118 and the pressing member 120, and thereafter past between the light emitting element 130a and the light receiving element 130b and between the guide rollers 144 to come in between the peeler 146 and the pressing rod 147.

Here, one end of the release paper 30 of the continuum of labels 12 is suddenly turned back, and past the guide roller 148 and between the feeder roller 150 and the nip roller 164 to the winding reel 174 to be fixed thereto.

Now, the motor 158 and the blower 188 are driven.

When the motor 158 is driven, the feeder roller 150 and the winding reel 174 is rotated, the release paper 30 of the continuum of labels 12 is wound by the winding reel 174 and it is suddenly turned back by the peeler 146 and the label 30 is peeled off from the release paper 30. The label 28 which is peeled off is led under the suction plate 182.

Meanwhile, sucking force is generated in the suction hole 184 of the suction plate 182 by the blower 188 etc., and the peeled label 28 is sucked to the underside of the suction plate 182.

When the motor 158 is driven, the disc 214 is rotated. When the disk 214 is rotated, the roller 220 comes into contact with the underside of the contact member 197, and the holding member 196 is displaced upward against the elasticity of the springs 210. Then, the pressing rods 192 are displaced upward together with the holding member 196.

The roller 220 comes off the contact member 197 at a predetermined position. When the roller 220 comes off the contact member 197, the holding member 196 is pushed downward by the elasticity of the springs 210. The pressing rods 192 are displaced downward together with the holding member 196. The label pushing members 194 then project through the suction hole 184 of the suction plate 182. Hence, the label 28 sucked to the underside of the suction plate 182 is pressed against the object to be labeled A conveyed by the conveyor 222.

The lowering holding member 196 is then suddenly stopped by the stopper 212. As the holding member 196 is stopped suddenly, the pressing rods 192 continue coming down by inertia against the elasticity of the springs 200. The label 28 sucked to the underside of the sucking plate 182 is then pressed against the object to be labeled A conveyed by the conveyor 222 to be stuck thereto.

Since the label 28 is then pressed by the plurality of pressing rods 192 which are held by the holding member 196 with the springs 200 free to advance or retreat, the object to be labeled A can be labeled precisely and neatly regardless of unevenness, stepping or slant therein.

Also, as the pressing rods 192 project by inertia downward, the label 28 can reach to be stuck onto the object to be labeled A even if it is too small.

Inversely, as the pressing rods 192 project against the elasticity of the springs 200, there is no risk of the object to be labeled A being crushed by the pressing rods 192 even if it is too big.

Also, since the underside of the pressing rods 192 is formed as the label pressing members 194 made of a soft material, the impact resulting from lowering of the pressing members 192 is absorbed thereby. Hence, there is no risk of the object to be labeled A being crushed by the lowering pressing rods 192.

Labeling over, the pressing rods 192 are restored to the original positions by the elasticity of the springs 200.

In the embodiment shown in FIGS. 9 and 10, two sets of pressing devices 190 are used, three or more sets thereof may as well be used according to the present invention.

While the present invention has been particularly described and shown, it is to be understood that such description is used merely as an illustration and example rather than limitation, and the sprit and scope of the present invention is determined solely by the terms of the appended claims.

What is claimed is:

1. A label sticking apparatus comprising:

a plurality of pressing means for pressing a label onto an object to be labeled;

a holding means for holding said plurality of pressing means with a first elastic body individually and free to advance or retreat;

a pushing-out means for pushing out said holding means along the advancing direction; and a stopping means for suddenly stopping said holding means having been pushed out along the advancing direction by said pushing-out means, wherein said plurality of pressing means are stopped by said stopping means and thereafter move by inertia along the advancing direction of said pressing means against the elasticity of said first elastic body.

2. A label sticking apparatus according to claim 1, wherein said pressing means includes pressing rods, and one end of said first elastic body is secured to the upper end of said pressing rod, and the other end of said first elastic body is secured to said holding means.

3. A label sticking apparatus according to claim 2, wherein said holding means includes a holding member for holding said pressing rods slidably, and a stopping member secured to said pressing rod and in contact with the underside of said holding member.

4. A label sticking apparatus according to claim 1, wherein said pushing-out means includes an actuator having a rod, and said rod of said actuator is secured to said holding means.

5. A label sticking apparatus according to claim 1, wherein said stopping means includes a stopper made of a cushioning material.

6. A label sticking apparatus according to claim 1, wherein said pushing-out means includes a second elastic body for pushing said holding means in the advancing direction of said pressing means, and displacing means which displaces said holding means in the retreating direction of said pressing means by a given distance against the elasticity of said second elastic body and then comes off said holding means, and said stopping means suddenly stops said holding means which has been pushed out in the advancing direction of said pushing-out means.

7. A label sticking apparatus according to claim 6, wherein said displacing means comprises:

a disc disposed in the vicinity of said holding means;

a motor for driving said disc to rotate, and a contact member disposed on the outer periphery of said disc and causes said holding means to displace intermittently when said disk is rotating.

8. A label sticking apparatus according to claim 7, wherein said contact member includes a roller.

* * * * *